US008701401B2

(12) United States Patent
Ooi et al.

(10) Patent No.: US 8,701,401 B2
(45) Date of Patent: Apr. 22, 2014

(54) ENGINE CONTROL DEVICE

(75) Inventors: Takeshi Ooi, Kanagawa (JP); Masashi Ichihara, Kanagawa (JP); Teruo Akiyama, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/577,205

(22) PCT Filed: Feb. 1, 2011

(86) PCT No.: PCT/JP2011/051996
§ 371 (c)(1),
(2), (4) Date: Aug. 3, 2012

(87) PCT Pub. No.: WO2011/096382
PCT Pub. Date: Aug. 11, 2011

(65) Prior Publication Data

US 2012/0304634 A1 Dec. 6, 2012

(30) Foreign Application Priority Data

Feb. 3, 2010 (JP) ..... 2010-022344

(51) Int. Cl.
*F02D 29/04* (2006.01)

(52) U.S. Cl.
USPC ..... 60/431

(58) Field of Classification Search
USPC ..... 60/431
See application file for complete search history.

(56) References Cited

U.S. PATENT DOCUMENTS

| | | | | |
|---|---|---|---|---|
| 5,077,973 | A * | 1/1992 | Suzuki et al. | 60/431 |
| 5,155,996 | A * | 10/1992 | Tatsumi et al. | 60/431 |
| 2002/0126570 | A1 | 9/2002 | Kamoshida et al. | |
| 2010/0332102 | A1 | 12/2010 | Akiyama et al. | |

FOREIGN PATENT DOCUMENTS

| | | | |
|---|---|---|---|
| JP | 10273919 | A | 10/1998 |
| JP | 2002266671 | A | 9/2002 |
| JP | 2008180203 | A | 8/2008 |
| WO | 2009104636 | A1 | 8/2009 |

* cited by examiner

*Primary Examiner* — F. Daniel Lopez
(74) *Attorney, Agent, or Firm* — Fish & Richardson P.C.

(57) ABSTRACT

A first target engine speed is set in response to a command value commanded by a command unit and a second target engine speed lower than the first target engine speed is set based on the first target engine speed. A reduction range from the first target engine speed to the second target engine speed is set according to a type of a hydraulic actuator operated by an operation lever or a combination of plural hydraulic actuators operated by an operation lever.

4 Claims, 13 Drawing Sheets

ENGINE CONTROL DEVICE

CROSS-REFERENCE TO RELATED APPLICATIONS

This application claims priority to Application No. PCT/JP2011/051996 filed Feb. 1, 2011, which application claims priority to Japanese Application No. 2010-022344, filed on Feb. 3, 2010. The contents of the above applications are incorporated herein by reference in their entireties.

TECHNICAL FIELD

The present invention relates to an engine control device that controls drive of an engine based on a set target engine speed, more specifically, an engine control device with an enhanced fuel consumption of the engine.

BACKGROUND ART

In a construction machine, when a pump absorption torque is equivalent to or lower than a rated engine torque, an engine output torque is matched to the pump absorption torque in a high-speed control area on an engine-output-torque-characteristics line showing a relationship between an engine speed and the engine output torque. For instance, the target engine speed is set corresponding to the setting of a fuel dial and a high-speed control area is determined corresponding to this target engine speed.

Alternatively, the high-speed control area is set corresponding to the setting of the fuel dial and the target engine speed is set corresponding to this high-speed control area. The pump absorption torque and the engine output torque are controlled for matching in this high-speed control area.

Many operators generally set a target engine speed at or around a rated engine speed so as to improve a workload. A low engine-fuel-consumption area (i.e., an engine-fuel-efficient area) usually exists in a middle-speed area and a high-torque area on the engine-output-torque-characteristics line. Accordingly, a high-speed control area defined between a non-load high-idle speed and the rated engine speed does not correspond to an efficient area in terms of fuel consumption.

In order to drive an engine in the fuel-efficient area, a typically known control device presets a value of a target engine speed and a value of a target engine output torque such that the values correspond to each other, for each of plural selectable operation modes (see, for instance, Patent Literature 1). With the use of such a control device, when an operator selects, for instance, a second operation mode, the engine speed can be set lower than that in a first operation mode, and therefore the fuel consumption can be improved.

However, according to the above-described operation mode switching, the operator needs to operate the operation mode switching each time so as to improve the fuel consumption. Further, in a situation where the engine speed in the second operation mode is set at a value simply reduced relative to the engine speed in the first operation mode, selection of the second operation mode leads to the following problem.

The maximum speed of a working device of a construction machine (hereinafter referred to as a working equipment) is decreased as compared to that in the first operation mode. As a result, a workload in the second operation mode becomes smaller than that in the first operation mode.

In order to solve this problem, the applicant has already filed a patent application directed to an engine control device and an engine control method (Patent Literature 2). According to the above engine control device, when a pump capacity and an engine output torque are low, the drive control of engine is conducted based on the second target engine speed that is closer to a low-speed area than the preset first target engine speed, thereby reaching the preset target engine speed corresponding to the pump capacity of a variable displacement hydraulic pump driven by the engine or the detected engine output torque.

According to the above engine control device, the fuel consumption of the engine is improvable and the engine speed is excellently smoothly changeable while a pump discharge amount required for the working equipment is maintained. Furthermore, an uncomfortable feeling resulting from a discontinuous change in engine noise can be prevented.

CITATION LIST

Patent Literature(s)

Patent Literature 1: JP-A-10-273919

Patent Literature 2: International Publication No. WO2009/104636

SUMMARY OF THE INVENTION

Problem to be Solved by the Invention

In the invention of the engine control device described in Patent Literature 2, the drive control of the engine is started based on the second target engine speed lower than the first target engine speed, instead of the first target engine speed instructed using a fuel command dial or the like. However, the invention of Patent Literature 2 fails to disclose setting the second target engine speed according to a type of a hydraulic actuator operated by an operation lever or a combination of a plurality of hydraulic actuators operated by the operation lever.

Particularly, allowance of the pump capacity in the hydraulic pump differs depending on which hydraulic actuator is operated or which hydraulic actuators in combination are operated. For instance, when a bucket-operation and an arm-operation are simultaneously performed, the total of pressure oil flow volumes supplied to hydraulic actuators respectively for the bucket-operation and the arm-operation needs to be large.

However, for instance, when an excavation operation is performed using a bucket alone, a pressure oil flow volume to be supplied into the hydraulic actuator for operating the bucket does not need to be so large. Accordingly, even when the hydraulic pump is driven for rotation at the same engine speed, it is not necessary to increase the pump capacity of the hydraulic pump.

An object of the invention is to modify the invention of Patent Literature 2 described above, more specifically, to provide an engine control device that not only ensures a pressure oil flow volume required for an operation of a hydraulic actuator without adversely affecting the operation of the hydraulic actuator even when a drive control of the engine is conducted based on the second target engine speed lower than the first target engine speed, but also more efficiently conducts the drive control of the engine at a low fuel consumption.

Means for Solving the Problems

The problem of the invention can be suitably solved by the following aspects of the invention on an engine control device.

According to an aspect of the invention, an engine control device includes: a variable displacement hydraulic pump driven by an engine; a plurality of hydraulic actuators driven by a discharge pressure oil from the hydraulic pump; a plurality of control valves that control the discharge pressure oil from the hydraulic pump so that the discharge pressure oil is supplied to the plurality of hydraulic actuators; at least one operation lever that controls the plurality of control valves; a detector that detects a pump capacity of the hydraulic pump; a fuel injector that controls a fuel supplied to the engine; a command unit that selects a command value among variable command values and commands the command value; a first setting unit that sets a first target engine speed in response to the command value commanded by the command unit and a second target engine speed based on the first target engine speed, the second target engine speed being lower than the first target engine speed; a second setting unit that sets a target engine speed according to the pump capacity, the target engine speed having the second target engine speed as a lower limit; and a controller that controls the fuel injector so as to provide the target engine speed set by the second setting unit, in which a reduction range from the first target engine speed to the second target engine speed is set in the first setting unit according to a type of the hydraulic actuator operated by the operation lever or a combination of the plurality of hydraulic actuators operated by the operation lever.

In the engine control device according to the above aspect of the invention, a value of the reduction range is set according to a maximum flow volume required by the type of the hydraulic actuator operated by the operation lever, or according to the combination of the plurality of hydraulic actuators operated by the operation lever.

In the engine control device according to the above aspect of the invention, a value of a pump capacity at which the target engine speed is increased beyond the second target engine speed is set to become smaller in the second setting unit as the reduction range becomes larger.

The engine control device according to the above aspect of the invention further includes a detector that detects an engine output torque, in which the second setting unit sets the target engine speed according to the pump capacity or the engine output torque, the target engine speed having the second target engine speed as the lower limit.

Advantages of the Invention

In the engine control device of the invention, the second target engine speed lower than the first target engine speed can be set based on the set first target engine speed. A reduction range from the first target engine speed to the second target engine speed is set according to a type of a hydraulic actuator operated by an operation lever or a combination of a plurality of hydraulic actuators operated by an operation lever. In other words, the respective reduction ranges depending on the type of the operated hydraulic actuator or the combination of the plurality of hydraulic actuators are set.

With this arrangement, the hydraulic actuator is operable with decreased fuel consumption of the engine while the operation of the hydraulic actuator is not adversely affected. Moreover, the pressure oil flow volume required for the hydraulic actuator to be operated is obtainable by driving the hydraulic pump at the second target engine speed lower than the first target engine speed. Furthermore, even when the drive control of the engine is conducted at the second target engine speed lower than the first target engine speed, the pressure oil flow volume required for operating the hydraulic actuator can be discharged from the hydraulic pump by increasing the pump capacity of the hydraulic pump.

With the arrangement according to the second aspect of the invention, the pressure oil flow volume required for the hydraulic actuator operated by the operation lever or the total of the pressure oil flow volumes required for the plurality of hydraulic actuators can be constantly discharged from the hydraulic pump.

With the arrangement according to the third aspect of the invention, the engine speed can be quickly raised in response to increase in the pump capacity, thereby adjusting an insufficient flow volume caused by setting the engine speed at the second target engine speed lower than the first target engine speed.

With the arrangement according to the fourth aspect of the invention, the hydraulic actuator is smoothly operable at a high efficiency while the operation of the hydraulic actuator is not adversely affected.

DESCRIPTION OF EMBODIMENT(S)

An exemplary embodiment of the invention will be specifically described below with reference to the attached drawings. An engine control device according to the invention can be favorably employed as a control device for controlling an engine installed in a construction machine such as a hydraulic excavator, a bulldozer and a wheel loader.

Moreover, the engine control device according to the invention may be shaped or configured in any manner other than those described below as long as they serve to attain an object of the invention. Accordingly, the invention is not limited to the exemplary embodiment described below but various modifications or changes can be made thereto.

Example(s)

Figure 1:
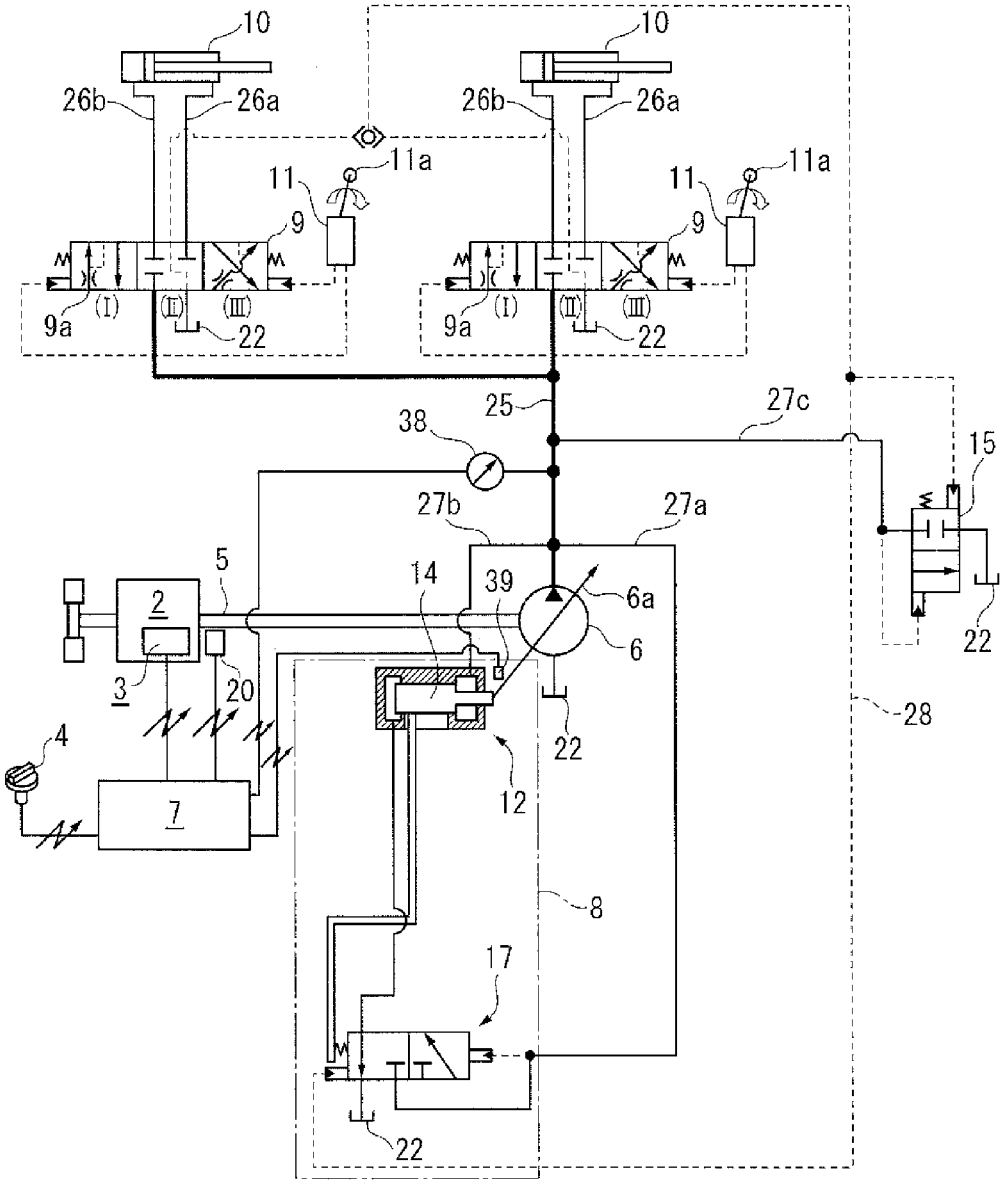
FIG. 1 is a hydraulic circuit diagram according to an exemplary embodiment of the invention.

FIG. 1 is a hydraulic circuit diagram of an engine control device according to the exemplary embodiment of the invention. An engine 2 is a diesel engine. An engine output torque of the engine 2 is controlled by adjusting a fuel amount ejected into a cylinder of the engine 2. A typically known fuel injection device 3 can adjust the fuel amount.

An output shaft 5 of the engine 2 is connected to a variable displacement hydraulic pump 6 (hereinafter referred to as a hydraulic pump 6), so that the rotation of the output shaft 5 drives the hydraulic pump 6. The inclination angle of a swash plate 6*a* of the hydraulic pump 6 is controlled by a pump control device 8. A change in the inclination angle of the swash plate 6*a* leads to a change in a pump capacity D (cc/rev) of the hydraulic pump 6.

The pump control device 8 includes: a servo cylinder 12 that controls the inclination angle of the swash plate 6*a*; and an LS valve (Load Sensing valve) 17 that is controlled in response to a differential pressure between a pump pressure and a load pressure of a hydraulic actuator 10. The servo cylinder 12 includes a servo piston 14 that acts on the swash plate 6*a*. A discharge pressure from the hydraulic pump 6 is applied to the servo piston 14 through oil paths 27*a* and 27*b*. The LS valve 17 is activated in response to a differential pressure between a hydraulic pressure (a pump discharge pressure) of the oil path 27*a* and a hydraulic pressure (the load pressure of the hydraulic actuator 10) of a pilot oil path 28, thereby controlling the servo piston 14.

The inclination angle 6*a* of the hydraulic pump 6 is controlled by the servo piston 14. Moreover, a control valve 9 is controlled by a pilot pressure outputted from an operation lever device 11 in response to the operation amount of an operation lever 11*a*, thereby controlling the flow volume supplied to the hydraulic actuator 10. The pump control device 8 is provided by a known load sensing control device.

A pressure oil discharged from the hydraulic pump 6 is supplied to the control valve 9 through an oil discharge path 25. The control valve 9 is configured as a five-port three position switching valve. The pressure oil discharged from the control valve 9 is selectively supplied to the oil paths 26*a* or 26*b*, thereby actuating the hydraulic actuator 10.

It is not to be understood that the hydraulic actuator is limited to the above-exemplified cylinder hydraulic actuator. The hydraulic actuator may be provided by a hydraulic motor or a rotary hydraulic actuator. Though only two pairs of the control valve 9 and the hydraulic actuator 10 are exemplified above, more than two pairs of the control valves 9 and the hydraulic actuators 10 may be provided. Moreover, a plurality of hydraulic actuators may be configured to be operated by a single control valve.

For instance, the operation lever 11*a* of the operation lever device 11 may be operable by the operator in two operation directions (front-back direction and right-left direction), whereby separate control valves may be switchable depending on the operation directions.

When a hydraulic excavator of a construction machine, for instance, is taken as an example for illustrating the hydraulic actuator operated by the operation lever device 11, the hydraulic actuator is employed for each of a boom hydraulic cylinder, an arm hydraulic cylinder, a bucket hydraulic cylinder, a left-travel hydraulic motor, a right-travel hydraulic motor, a turning motor and the like. FIG. 1 shows the arm hydraulic cylinder and the boom hydraulic cylinder, for instance, as representative examples of these hydraulic actuators.

When the operation lever 11*a* is moved from a neutral position, a pilot pressure is outputted from the operation lever device 11 according to the operation direction and the operation amount of the operation lever 11*a*. The outputted pilot pressure is applied to either a left pilot port or a right pilot port of the control valve 9. In this manner, the control valve 9 is switched from a (II) position (neutral position) to either one of left and right positions, namely a (I) position and a (III) position.

When the control valve 9 is switched from the (II) position to the (I) position, the discharge pressure oil from the hydraulic pump 6 is supplied to the bottom side of the hydraulic actuator 10 through the oil path 26*b*, whereby a piston of the hydraulic actuator 10 is expanded. At this time, the pressure oil at the head side of the hydraulic actuator 10 is discharged into a tank 22 from the oil path 26*a* via the control valve 9.

Likewise, when the control valve 9 is switched to the (III) position, the discharge pressure oil from the hydraulic pump 6 is supplied to the head side of the hydraulic actuator 10 through the oil path 26*b*, whereby the piston of the hydraulic actuator 10 is retracted. At this time, the pressure oil at the bottom side of the hydraulic actuator 10 is discharged into the tank 22 from the oil path 26*b* via the control valve 9.

Herein, the head side of the hydraulic actuator 10 means a hydraulic chamber near a rod of the hydraulic cylinder. The bottom side of the hydraulic actuator 10 means a hydraulic chamber at the opposite side of the rod of the hydraulic cylinder.

An oil path 27*c* is branched from the middle of the oil discharge path 25. An unload valve 15 is disposed in the oil path 27*c*. The unload valve 15 is connected to the tank 22. The unload valve 15 is switchable between a position where the oil path 27*c* is cut off and a position where the oil path 27*c* is in communication. The oil pressure in the oil path 27*c* acts as a pressing force for switching the unload valve 15 to the communication position.

Moreover, a pilot pressure in the pilot oil path 28 where the load pressure of the hydraulic actuator 10 is taken and a pressing force of the spring act as a pressing force for switching the unload valve 15 to the cut-off position. Hence, the unload valve 15 is controlled based on a differential pressure between the combination of the pilot pressure in the pilot oil path 28 and the pressing force of the spring and the oil pressure in the oil path 27*c*.

The operator selects one command value of variable command values by turning a fuel dial 4 (a command unit), thereby setting a first target engine speed corresponding to the selected command value. Corresponding to the set first target engine speed, a high-speed control area where a pump absorption torque and an engine output torque are matched can be set.

Figure 2:
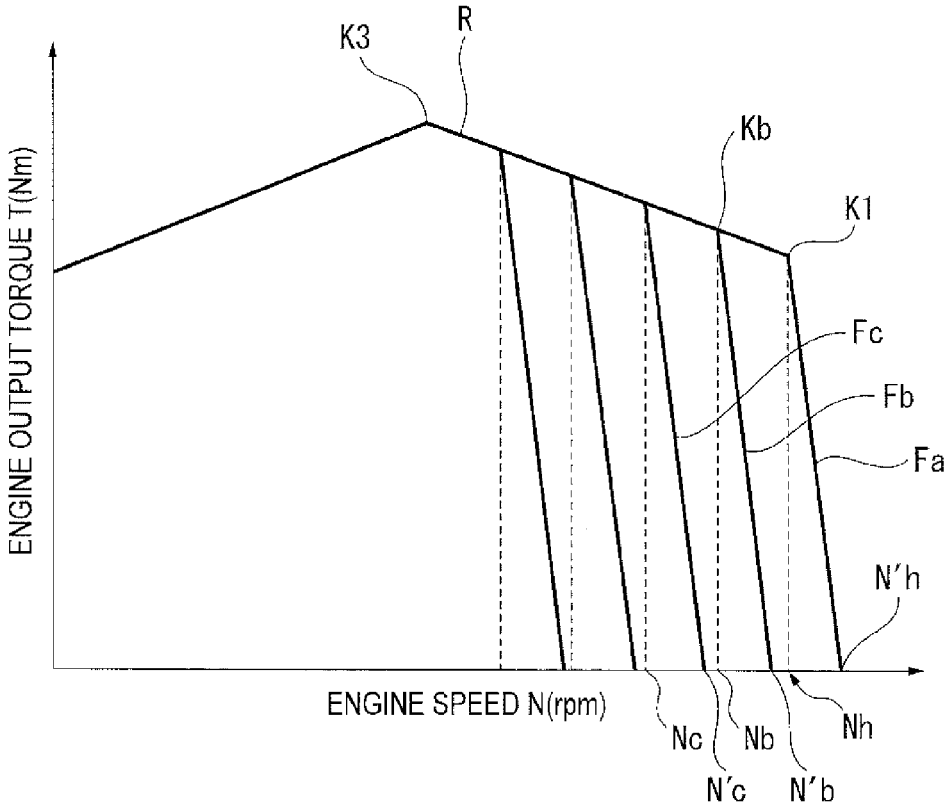
FIG. 2 shows an engine-output-torque-characteristics line.

Specifically, as shown in FIG. 2, when a target engine speed Nb(N'b) as the first target engine speed is set by turning the fuel dial 4, a high-speed control area Fb is selected corresponding to the target engine speed Nb(N'b). At this time, the target engine speed is Nb(N'b).

The target engine speed N'b is defined as a point where the total of a non-load engine friction torque and a hydraulic loss torque and the engine output torque are matched when the target engine speed is controlled at Nb. In an actual engine control, a line connecting the target engine speed N'b and a matching point Kb is set as the high-speed control area Fb.

Although the target engine speed N'b is exemplarily set higher than the target engine speed Nb in the following description, the target engine speed N'b and the target engine speed Nb may be the same, or the target engine speed N'b may be set lower than the target engine speed Nb. In the following description, an engine speed N'c marked with the apostrophe (e.g., a target engine speed Nc(N'c)) is described. The engine speed N'c marked with the apostrophe is defined in the same manner as the above.

When the operator newly sets a first target engine speed Nc lower than the initially selected first target engine speed Nb by turning the fuel dial 4, a high-speed control area Fc is selected in a lower speed area.

In this manner, by setting the fuel dial 4, one high-speed control area is set corresponding to the first target engine speed selectable by the fuel dial 4. Specifically, when the fuel dial 4 is selectively set, as exemplarily shown in FIG. 2, any one of the high-speed control area Fa passing a maximum horsepower point K1 and a plurality of the high-speed control areas Fb, Fc and so forth in the lower speed area relative to the high-speed control area Fa can be set, or any one of high-speed control areas defined between the above high-speed control areas can be set.

Figure 3:
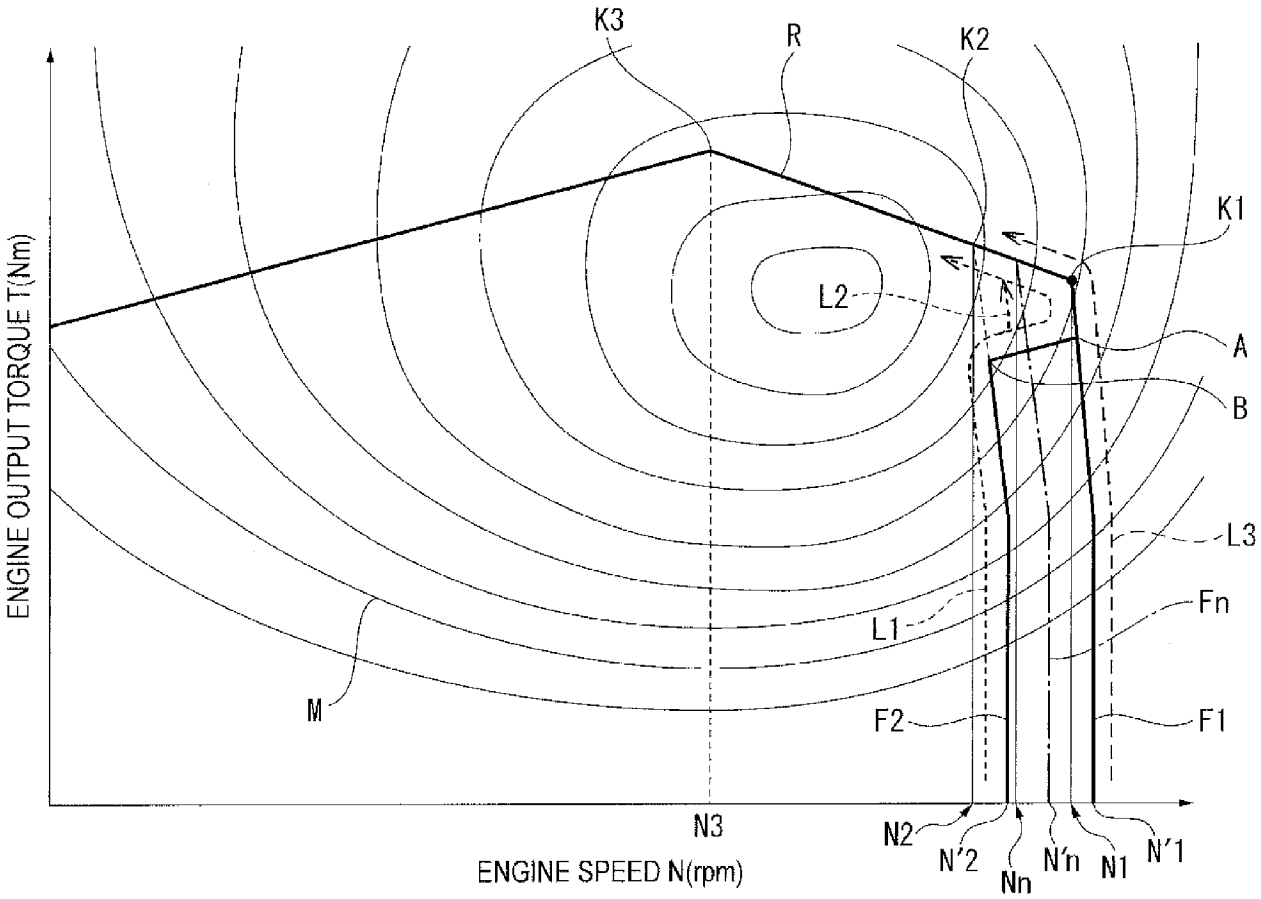
FIG. 3 shows an engine-output-torque-characteristics line when an engine output torque is increased.

In the engine-output-torque-characteristics line of FIG. 3, the possible performance of the engine 2 is shown as an area defined by a maximum torque line R. The output (horsepower) of the engine 2 peaks at the maximum horsepower point K1 on the maximum torque line R. M denotes a fuel consumption map. The minimum fuel consumption area is defined near the center of the fuel consumption map. K3 on the maximum torque line R denotes the maximum torque point where the torque of the engine 2 peaks.

Description will be made below on an explanatory situation where a first target engine speed N1 is set as the maximum target engine speed corresponding to a command value of the fuel dial 4 and a high-speed control area F1 passing the maximum horsepower point K1 is set corresponding to the first target engine speed N1.

Description will be made below on an explanatory situation where the first target engine speed N1 is set as the rated engine speed corresponding to the command value of the fuel dial 4 in FIG. 1 (although the rated engine speed is denoted as Nh in FIG. 2, the rated engine speed is also denoted as the first target engine speed N1 in FIG. 3) and the high-speed control area F1 passing the maximum horsepower point K1 is set corresponding to the first target engine speed N1.

However, the invention is not limited to the situation where the high-speed control area F1 passing the maximum horsepower point K1 is set. For instance, even if any one of the plurality of high-speed control areas Fb, Fc and so forth or any one of the high-speed control areas defined between the high-speed control areas Fb, Fc and so forth is set as the high-speed control area corresponding to the determined first target engine speed in FIG. 2, the invention is favorably applied to the determined high-speed control area.

FIG. 3 illustrates an increasing pattern of the engine output torque. In the invention, the high-speed control area F1 can be set corresponding to the first target engine speed N1 that is set corresponding to the command value of the fuel dial 4 set by the operator. In the same manner, the second target engine speed N2 is set lower than the first target engine speed N1 and a high-speed control area F2 is set corresponding to the second target engine speed N2, thereby starting controlling drive of the engine based on the high-speed control area F2. The second target engine speed N2 is set according to a type of a hydraulic actuator to be operated or a combination of hydraulic actuators to be operated as described below.

A controller 7 can be provided by, for instance, a computer including a storage that is used as a program memory and a work memory and a CPU that executes a program. The storage of the controller 7 stores Tables 1 to 3 of FIGS. 10A to 10C, a relationship shown in FIG. 11, a relationship shown in FIG. 12, and the like.

Figure 4:
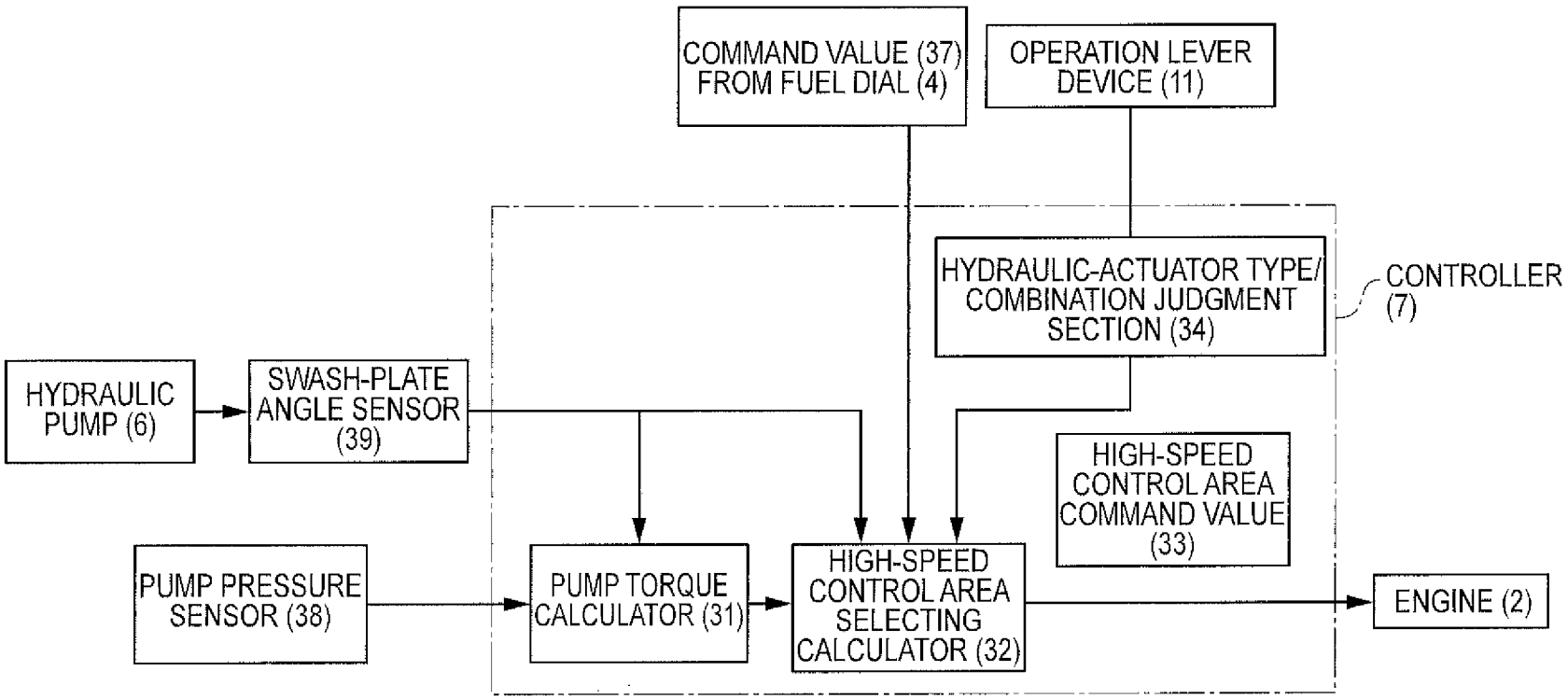
FIG. 4 is a block diagram of a controller.

Next, the control of the controller 7 will be described with reference to the block diagram of FIG. 4. In FIG. 4, a high-speed control area selecting calculator 32 in the controller 7 receives not only a command value 37 of the fuel dial 4 but also a command value of the pump torque required for the hydraulic pump 6 which is calculated by a pump torque calculator 31, a pump capacity corresponding to a swash-plate angle of the hydraulic pump 6, and a judgment result from a hydraulic-actuator type/combination judgment section 34.

The pump torque calculator 31 receives a pump pressure discharged from the hydraulic pump 6 (a pump discharge pressure) which is detected by a pump pressure sensor 38 and the swash-plate angle of the hydraulic pump 6 which is detected by a swash-plate angle sensor 39. The pump torque calculator 31 calculates a pump torque (the engine output torque) from the inputted swash-plate angle and pump pressure of the hydraulic pump 6.

Specifically, in general, a relationship in the hydraulic pump 6 between the pump discharge pressure P (pump pressure P), the discharge capacity D (pump capacity D), and the engine output torque T is expressed by an equation $T=P\cdot D/200\pi$.

The pump torque calculator 31, the pump pressure sensor 38 and the swash-plate angle sensor 39 function as a detector detecting the engine output torque. Moreover, the swash-plate angle sensor 39 functions as a detector detecting the pump capacity of the hydraulic pump.

Figure 5:
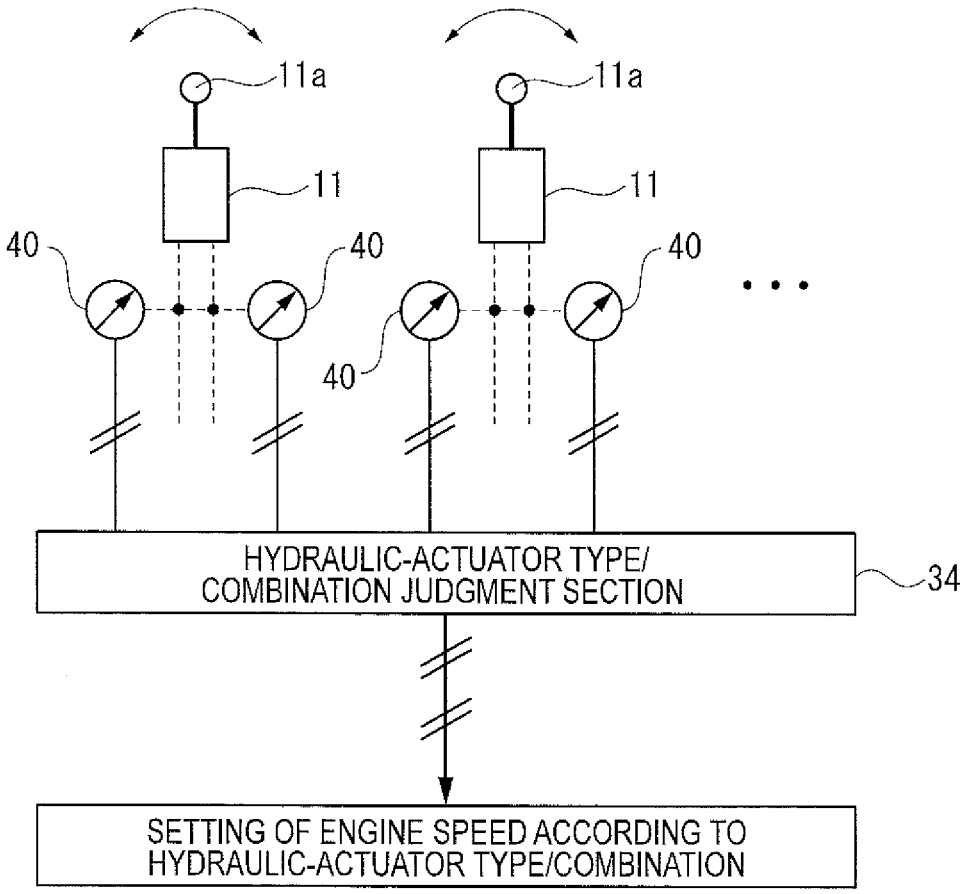
FIG. 5 illustrates that a second target engine speed is set in response to an operation lever.

When a plurality of operation lever devices 11 are operated as shown in FIG. 5, the hydraulic-actuator type/combination judgment section 34 receives signals respectively indicating that pressure sensors 40 detect pilot pressures outputted from the operation lever devices 11, thereby judging which hydraulic actuators are operated by the operator.

In other words, a type of the operated hydraulic actuator or a combination of those can be determined by judging which operation lever 11*a* is operated when one of the operation levers 11*a* is operated alone, or which the operation levers 11*a* are used in combination when the plurality of the operation levers 11*a* are operated. In FIG. 5, although the pressure sensor 40 detects the pilot pressure, a potentiometer or the like may be used to detect displacement of the operation lever 11*a*.

Figure 6A:
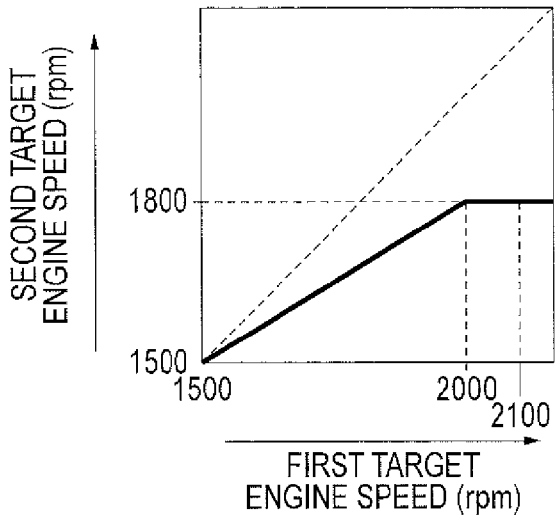
FIG. 6A illustrates a relationship between a first target engine speed and the second target engine speed.
Figure 6B:
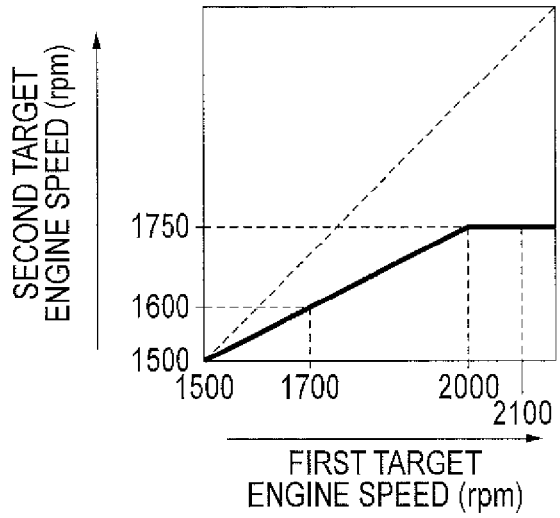
FIG. 6B illustrates another relationship between the first target engine speed and the second target engine speed.
Figure 6C:
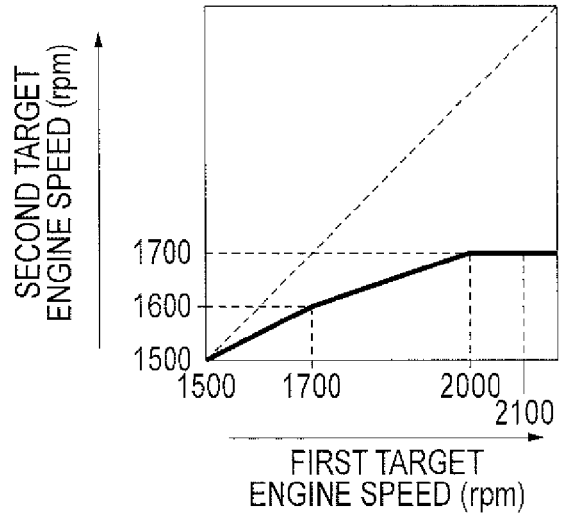
FIG. 6C illustrates still another relationship between the first target engine speed and the second target engine speed.

Based on the input signal from the hydraulic-actuator type/combination judgment section 34, in response to the input signal from the hydraulic-actuator type/combination judgment section 34, the high-speed control area selecting calculator 32 selects one of correspondence tables representing the relationships between the first target engine speed N1 and the second target engine speed N2 as shown in FIGS. 6A to 6C. The high-speed control area selecting calculator 32 commands a high-speed control area command value 33 to the engine 2 for drive control thereof. It should be noted that the correspondence tables of FIGS. 6A to 6C are taken as an example and any correspondence table may be set as needed according to a construction machine or the like.

Figure 7:
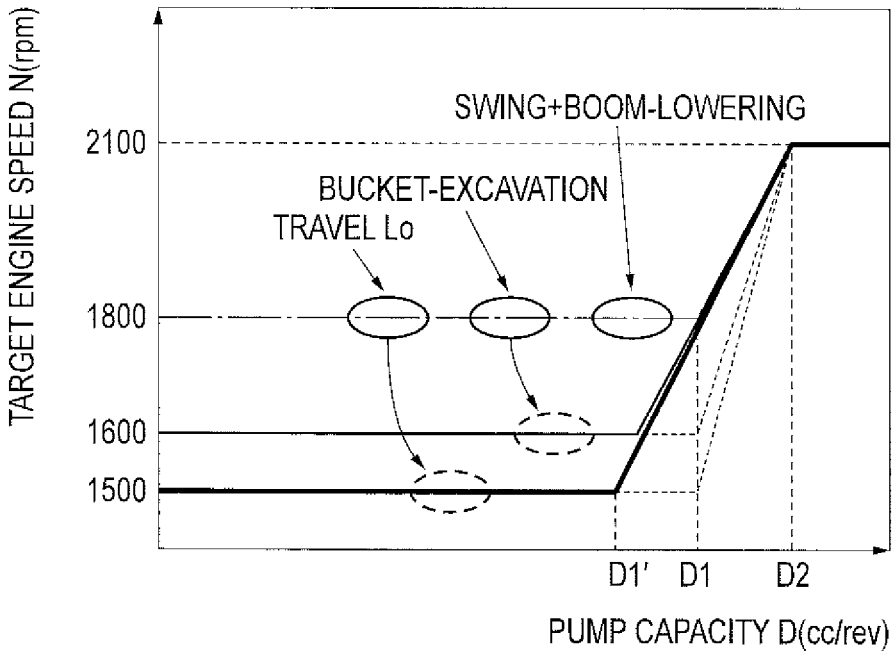
FIG. 7 illustrates a relationship of the first target engine speed and the second target engine speed relative to a pump capacity.

FIG. 7 illustrates a relationship between the first target engine speed N1 and the second target engine speed N2 relative to the pump capacity D of the hydraulic pump. Setting of the second target engine speed N2 according to a type of a hydraulic actuator to be operated or a combination of hydraulic actuators to be operated will be described with reference with FIG. 7.

When the first target engine speed N1 is set, for instance, at 2100 rpm, description will be made on an explanatory situation where the second target engine speed N2 is set at 1800 rpm without considering a type and a combination of the hydraulic actuators to be operated. In short, the second target engine speed N2 is represented by a chain line.

Here, the second target engine speed N2 is set at 1800 rpm as shown in a circle by a solid line in an operation of a travel hydraulic actuator (a hydraulic motor) for low-speed travel, an operation for bucket-excavation, and an operation for arm-excavation.

It should be noted that the circles by the solid line are differently positioned on the chain line representing 1800 rpm in FIG. 7. This is because the pump capacity D required for operating each of the hydraulic actuators, namely, the maximum flow volume is different depending on the hydraulic actuators when the second target engine speed N2 is set at 1800 rpm.

For instance, a pressure oil flow volume required for operating the travel hydraulic actuator for low-speed travel is not so much as a pressure oil flow volume required for the operation for arm-excavation.

In the invention, the second target engine speed N2 is set at a lower engine speed according to a type of a hydraulic actuator to be operated or a combination of hydraulic actuators to be operated. In other words, due to the low maximum flow volume required for operating travel hydraulic actuator for low-speed travel, the pump capacity D required for this operation has allowance as shown in FIG. 7. Accordingly, the pump capacity D can be increased. By increasing the pump capacity D, the second target engine speed N2 can be set at 1500 rpm lower than 1800 rpm (i.e., the second target engine speed N2 is shifted from the position of the circle by the solid line to a position of a circle by a dotted line as shown by an arrow line). In short, the second target engine speed N2 is represented by a bold line.

On the other hand, the pump capacity D can also be increased in the operation of bucket-excavation. However, the pump capacity D required for operation of bucket-excavation, namely, the maximum flow volume is larger than the pump capacity D required for the operation for low-speed travel. For this reason, the second target engine speed N2 cannot be decreased from 1800 rpm to 1500 rpm. However, the second target engine speed N2 can be set at 1600 rpm lower than 1800 rpm (i.e., the second target engine speed N2 can be shifted from the position of the by the solid line to the position of the circle by the dotted line as shown by the arrow line). In other words, the second target engine speed N2 is represented by a fine line.

In the operation for arm-excavation or a combined operation of swing and boom-lowering, when the second target engine speed N2 is set at a lower engine speed, the pump capacity D required for the operation for arm-excavation or the combined operation of swing and boom-lowering becomes equivalent to or exceeds a predetermined first pump capacity D1. Accordingly, it is not possible to increase the pump capacity D and set the second target engine speed N2 at the lower engine speed. For this reason, the second target engine speed N2 is not set at the lower engine speed but is kept at 1800 rpm. In short, the second target engine speed N2 is represented by a chain line.

The first pump capacity D1 will be described. When the drive control of the engine 2 is conducted along the high-speed control area F2 based on the second target engine speed N2 (e.g., 1800 rpm in FIG. 7) as shown in FIG. 3, the drive control of the engine 2 is conducted along the high-speed control area F2 until the pump capacity D of the hydraulic pump 6 reaches a predetermined first pump capacity D1 (the first pump capacity D1 is shown as a first setting position B in FIG. 3).

When the pump capacity D of the hydraulic pump 6 becomes equivalent to or exceeds the first pump capacity D1 as shown in FIG. 7, the target engine speed N of the engine 2 is calculated based on a relationship between the pump capacity D and the target engine speed N. When the pump capacity D of the hydraulic pump 6 becomes equivalent to or exceeds a second pump capacity D2 (the second pump capacity D2 is shown as a second setting position A in FIG. 3), the drive control of the engine 2 is conducted along the high-speed control area F1.

In FIG. 3, the first setting position B and the second setting position A are fluctuated in an engine output torque T direction (vertical direction) according to a pump pressure P. The engine output torque T is expressed by an equation $T=P\cdot D/200\pi$ in relation to the pump pressure P and the pump capacity D. Accordingly, the first setting position B at which the first pump capacity D1 is reached is vertically fluctuated according to the pump pressure P that is fluctuated according to a load applied to the hydraulic actuator. The same applies to the second setting position A at which the second pump capacity D2 is reached.

The first pump capacity D1 will be further described with reference to FIG. 7. Description will be made on an explanatory situation where the travel hydraulic actuator is operated for low-speed travel and where the operation for arm-excavation is conducted. With regard to the first pump capacity D1, a value of the first pump capacity D1' when the travel hydraulic actuator is operated for low-speed travel is set at a value lower than a value of the first pump capacity D1 in the operation for arm-excavation.

With this setting, the engine speed can quickly be raised in response to increase in the pump capacity even when the drive control of the engine 2 along the high-speed control area F2 is changed to that along the high-speed control area F1 and the second target engine speed N2 is set at 1500 rpm lower than 1800 rpm.

In other words, the value of the first pump capacity D1 at which the target engine speed N is increased beyond the second target engine speed N2 is set to become smaller as a reduction range from the first target engine speed N1 to the second target engine speed N2 becomes larger.

In the invention, the second target engine speed N2 is set at a lower engine speed in consideration of the pump capacity D required for the hydraulic actuator or the combination of plural hydraulic actuators (i.e., the maximum flow volume) according to a type of the hydraulic actuator to be operated or the combination of hydraulic actuators to be operated.

Moreover, with regard to the first target engine speed N1 and the second target engine speed N2, a reduction range for setting the second target engine speed N2 lower than the first target engine speed N1 can be determined according to a type of the hydraulic actuator or a combination of plural hydraulic actuators operated by the operation lever 11*a* in the invention. Accordingly, such correspondence tables as shown in FIGS. 6A to 6C can be made.

The first target engine speed N1 and the second target engine speed N2 in the correspondence tables of FIGS. 6A to 6C are related as below to the first target engine speed N1 and the second target engine speed N2 in FIG. 7.

For instance, when the first target engine speed N1 in the correspondence table of FIG. 6A is made equivalent to the first target engine speed N1 (2100 rpm) in FIG. 7, the second target engine speed N2 in the correspondence table of FIG. 6A becomes equivalent to the second target engine speed N2 (1800 rpm) in FIG. 7.

Each of the correspondence tables of FIGS. 6A to 6C shows a relationship between a variably set first target engine speed N1 and its corresponding second target engine speed N2 when the first target engine speed N1 is changed by operating the fuel dial 4, after the first target engine speed N1 and the second target engine speed N2 in the correspondence tables of FIGS. 6A to 6C are made equivalent to the first target engine speed N1 (2100 rpm) and the second target engine speed N2 (1800 rpm, 1600 rpm or 1500 rpm) in FIG. 7.

For instance, when the setting of the first target engine speed N1 is changed from 2100 rpm to 1700 rpm by the fuel dial 4, if the correspondence table of FIG. 6C is selected, the second target engine speed N2 (1600 rpm) is selected corresponding to the first target engine speed N1 (1700 rpm). In other words, it is possible to select a reduction range for setting the second target engine speed N2 further lower than the first target engine speed N1 that is set at a low engine speed.

The second target engine speed N2 corresponding to the first target engine speed N1 set by the fuel dial 4 can be set by selecting the correspondence table according to a type of a hydraulic actuator to be operated or a combination of hydraulic actuators to be operated.

As shown in FIG. 4, based on a selected one of the correspondence tables in FIGS. 6A to 6C, the high-speed control area selecting calculator 32 sets the second target engine speed N2 corresponding to the first target engine speed N1 that is set in response to the command value 37 of the fuel dial 4. Accordingly, the high-speed control area selecting calculator 32 functions as a first setting unit that sets the second target engine speed N2 based on the first target engine speed N1 that is set in response to the command value 37 of the fuel dial 4.

A correspondence table can be selected from the correspondence tables of FIGS. 6A to 6C depending on cases such as an independent operation only for arm-excavation, a simultaneous operation for arm-excavation and bucket-excavation, and an independent operation only for bucket-excavation.

The use of the correspondence tables enables setting of the second target engine speed N2 that is lower than the first target engine speed N1. When a hydraulic actuator can be operated with a hydraulic pump having a pump capacity accounting for 85% or less of the maximum pump capacity, the second target engine speed N2 can be set at a further lower engine speed based on, for instance, the correspondence table of FIG. 6C.

Figure 8:
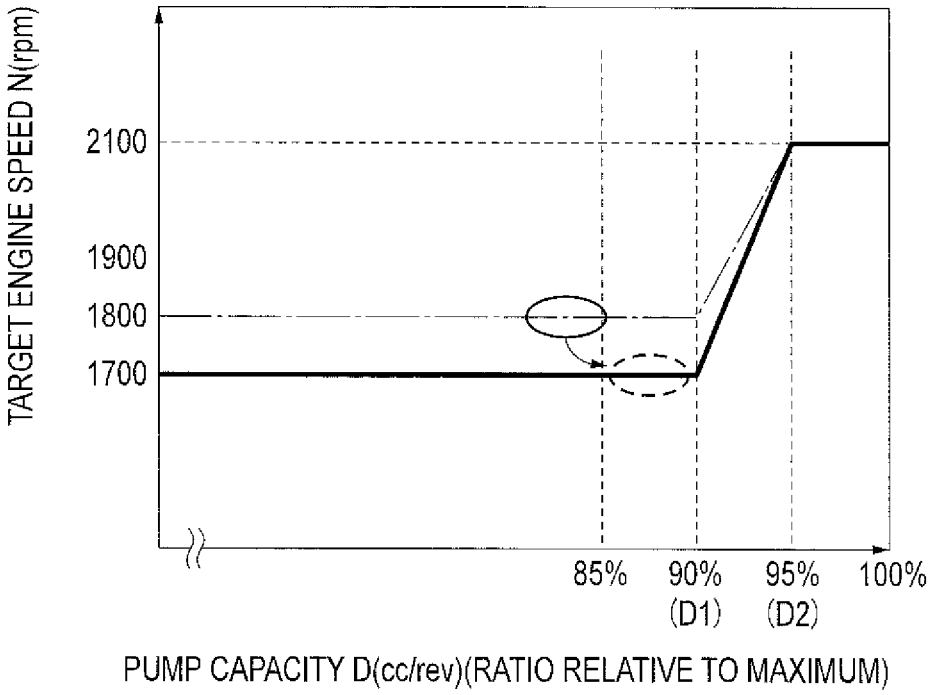
FIG. 8 illustrates another relationship of the first target engine speed and the second target engine speed relative to a ratio of the pump capacity.

FIG. 8 describes another Example. In FIG. 8, the abscissa axis shows a ratio of a pump capacity D relative to the maximum pump capacity of the hydraulic pump 6, which is not shown in FIG. 7. FIG. 8 shows a relationship of the ratio of the pump capacity D relative to the maximum pump capacity to the first target engine speed N1 and the second target engine speed N2.

Although partially duplicated with the description of FIG. 7, the second target engine speed N2 will be further described with reference to FIG. 8. FIG. 8 exemplarily shows a situation where, for operating a hydraulic actuator, the second target engine speed N2 is set at 1800 rpm if the second target engine speed N2 is set irrespective of a type and a combination of the hydraulic actuators.

When the second target engine speed N2 is set at 1800 rpm, the pump capacity D of the hydraulic pump required for this operation is assumed to be the pump capacity D at a position of a circle by a solid line on the 1800-rpm line. In other words, this operation can be conducted when the pump capacity D of the hydraulic pump accounts for about 85% of the maximum pump capacity. Here, the target engine speed N starts to decrease from 2100 rpm (the first target engine speed N1) when the pump capacity D accounts for 95% (the second pump capacity D2).

Accordingly, when the pump capacity D of the hydraulic pump 6 in which only about 85% of the maximum pump capacity is used is increased up to, for instance, 88%, the second target engine speed N2 can be decreased, for instance, from 1800 rpm to 1700 rpm.

In Example of FIG. 8, the line connecting the first pump capacity D1 and the second pump capacity D2 is largely inclined in order for the second target engine speed to be set at a further lower value. In other words, even when the second target engine speed is set at a further lower value, the value of the first pump capacity D1 is not decreased but is substantially kept at the same.

In Example of FIG. 8, it is important to set the second target engine speed at a further lower value as compared with Example of FIG. 7.

Next, description will be made on the control flow of FIG. 9.

Figure 9:
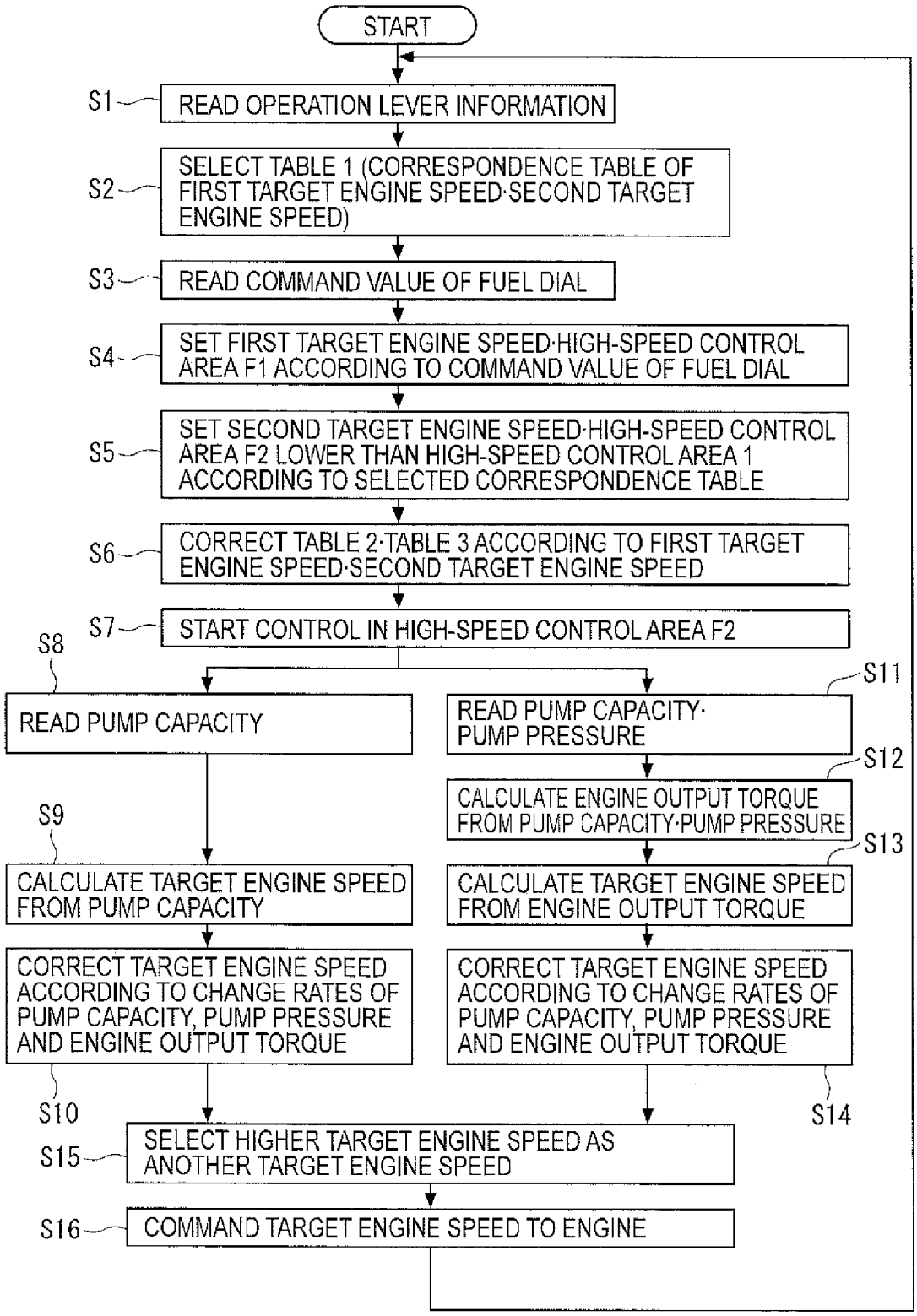
FIG. 9 is a control flow chart according to the invention.

In Step S1 of FIG. 9, the controller 7 reads information from the hydraulic-actuator type/combination judgment section 34 based on a detection signal on the operation lever to be operated, and the process proceeds to Step S2.

Figure 10A:
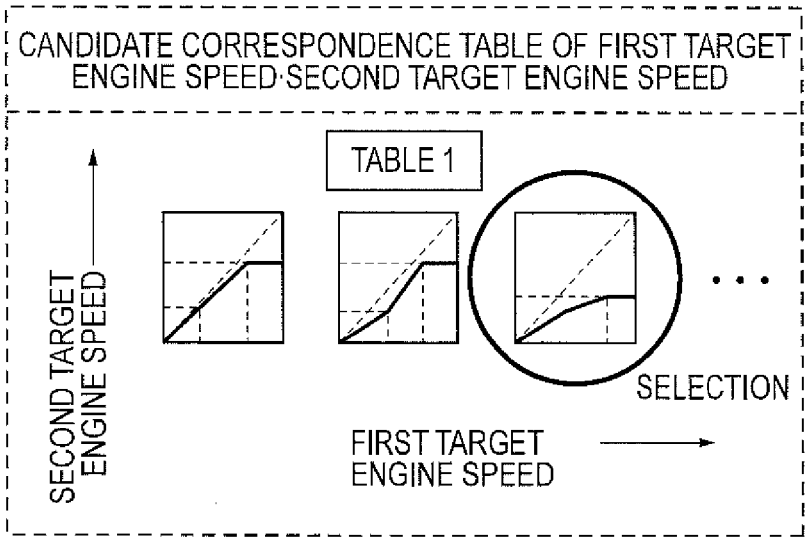
FIG. 10A illustrates a relationship between the first target engine speed and the second target engine speed.

In Step S2, based on the information from the hydraulic-actuator type/combination judgment section 34, a correspondence table is selected from Table 1 of FIG. 10A or candidate correspondence tables of the first target engine speed N1 and the second target engine speed N2 in FIGS. 6A to 6C.

For instance, when the first target engine speed N1 is fixed at a rated engine speed, the second target engine speed N2 corresponding to the first target engine speed N1 can be set according to a type of a hydraulic actuator to be operated or a combination of hydraulic actuators to be operated, as shown in FIG. 7. For instance, when the first target engine speed N1 is set lower than the rated engine speed of the engine 2 by operating the fuel dial 4, a reduction range for setting the second target engine speed N2 lower than the variable first target engine speed N1 can be selected using Table 1 of FIG. 10A or the correspondence tables of FIGS. 6A to 6C. It should be noted that FIGS. 6A to 6C are an enlarged view of Table 1 of FIG. 10A.

In other words, the second target engine speed N2 corresponding to the variable first target engine speed N1 can be selected by selecting the correspondence table according to a type of a hydraulic actuator to be operated or a combination of hydraulic actuators to be operated. After the correspondence table is selected, the process proceeds to Step S3.

In Step S3, the controller 7 reads the command value 37 of the fuel dial 4. The process then proceeds to Step S4.

In Step S4, the controller 7 sets the first target engine speed N1 in response to the read command value 37 of the fuel dial 4, whereby the high-speed control area F1 is set based on the set first target engine speed N1.

Although it is described above that the first target engine speed N1 of the engine 2 is initially set in response to the command value 37 of the fuel dial 4, the high-speed control area F1 can initially be set and the first target engine speed N1 can be set corresponding to the set high-speed control area F1. Alternatively, both the first target engine speed N1 and the high-speed control area F1 can simultaneously be set in response to the read command value 37 of the fuel dial 4.

As shown in FIG. 3, when the first target engine speed N1 and the high-speed control area F1 are set, the process proceeds to Step S5.

In Step S5, based on the correspondence table of Table 1 of FIG. 10A or one of the correspondence tables selected from those in FIGS. 6A to 6C, the second target engine speed N2 corresponding to the first target engine speed N1 and the high-speed control area F1, and the high-speed control area F2 corresponding to the second target engine speed N2 are set.

It should be noted that the values of the engine speed shown in Table 1 of FIG. 10A or the correspondence tables of FIGS. 6A to 6C are taken as an example and any value may be set as needed according to a construction machine.

When the controller 7 determines the high-speed control area F2, the process proceeds to Step S6.

In Step S6, Table 2 (FIG. 10B) for setting the target engine speed N based on the pump capacity D and Table 3 (FIG. 10C) for setting the target engine speed N based on the engine output torque T are corrected as follows.

Figure 10B:
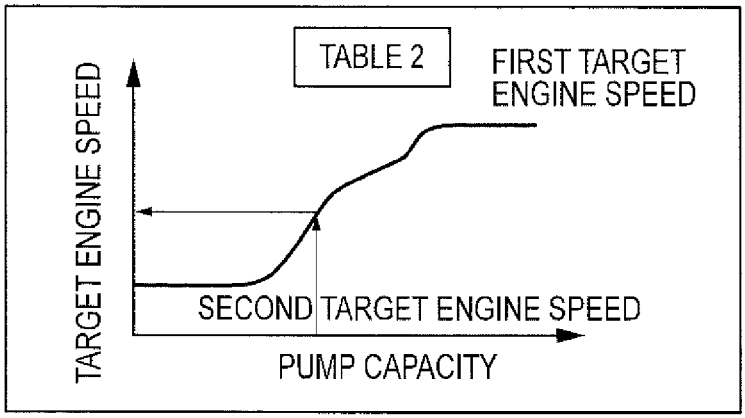
FIG. 10B illustrates a relationship between the pump capacity and the target engine speed.
Figure 10C:
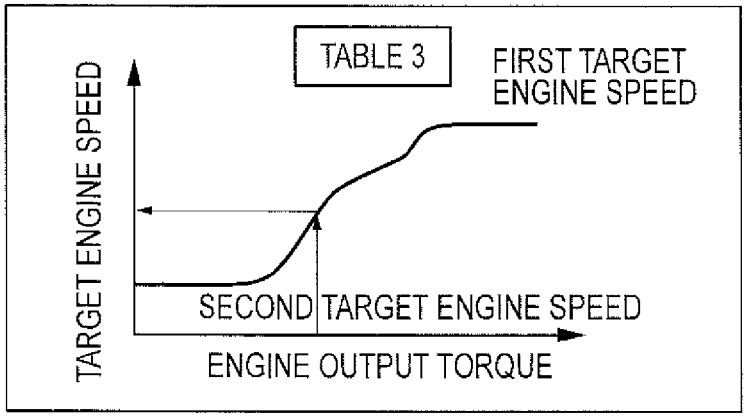
FIG. 10C illustrates a relationship between the engine output torque and the target engine speed.
Figure 11:
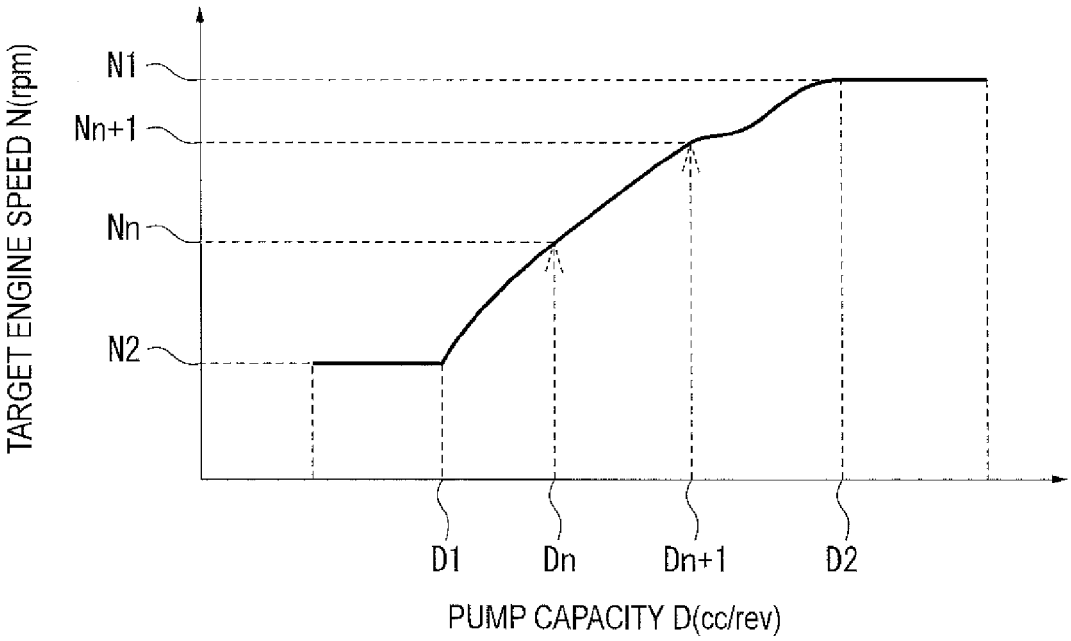
FIG. 11 illustrates a relationship between the pump capacity and the target engine speed.
Figure 12:
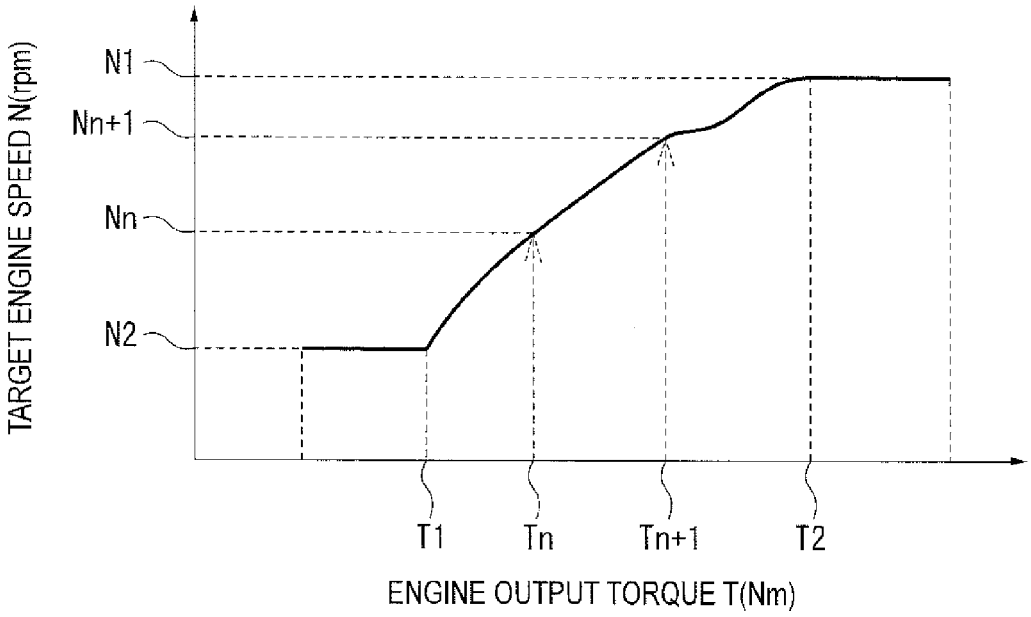
FIG. 12 illustrates a relationship between the engine output torque and the target engine speed.

In Table 2 of FIG. 10B and Table 3 of FIG. 10C, the first target engine speed N1 of the target engine speed N is set as the upper limit value and the second target engine speed N2 thereof is set as the lower limit. Consequently, Table 2 of FIG. 10B and Table 3 of FIG. 10C are corrected so as to show such a relationship as shown in FIGS. 11 and 12 according to a type of a hydraulic actuator to be operated or a combination of hydraulic actuators to be operated.

In Step S7, the drive control of the engine 2 is started in the high-speed control area F2 corresponding to the set second target engine speed N2, and then the process proceeds to Steps S8 or Step S11.

When the drive control of the engine 2 is conducted at the target engine speed N corresponding to the detected pump capacity D, Steps S8 to Step S10 are conducted. When the drive control of the engine 2 is conducted at the target engine speed N corresponding to the detected engine output torque T, Steps S11 to Step S14 are conducted.

Description will first be made on Steps S8 to Step S10 as control steps for obtaining the target engine speed corresponding to the detected pump capacity.

In Step S8, the swash-plate angle sensor 39 reads out the detected pump capacity D of the hydraulic pump 6. After reading of the pump capacity D in Step S8, the process proceeds to Step S9.

The following is a brief description on the process in Step S9 for obtaining the target engine speed N corresponding to the detected pump capacity D. As shown in FIG. 11, when the drive control of the engine is conducted based on the second target engine speed N2, the drive control of the engine based on the second target engine speed N2 continues until the pump capacity D of the hydraulic pump 6 reaches the predetermined first pump capacity D1.

When the detected pump capacity D of the hydraulic pump 6 becomes equivalent to or exceeds the first pump capacity D1, the target engine speed N corresponding to the detected pump capacity D is obtained based on the preset relationship between the pump capacity D and the target engine speed N shown in FIG. 11. At this time, the drive of the engine 2 is controlled so that the engine 2 is driven at the obtained target engine speed Nn.

Until the target engine speed Nn reaches the first target engine speed N1 or the second target engine speed N2, the target engine speed Nn corresponding to the detected pump capacity Dn is constantly obtained. The drive control of the engine 2 is thus constantly conducted at the obtained target engine speed Nn. In this control, the high-speed control area selecting calculator 32 functions as a second setting unit that sets the target engine speed corresponding to the pump capacity detected by the detector, the target engine speed having the second target engine speed as the lower limit.

When the currently-detected pump capacity D is the pump capacity Dn, the target engine speed N is obtained as the target engine speed Nn. Upon detection of an increase from the pump capacity Dn to a pump capacity Dn+1, a target engine speed Nn+1 corresponding to the pump capacity Dn+1 is newly obtained according to FIG. 11. The drive of the engine 2 is thus controlled so that the engine 2 is driven at this newly-obtained target engine speed Nn+1.

When the detected pump capacity D reaches the predetermined second pump capacity D2, the drive control of the engine 2 is conducted based on the first target engine speed N1. When the drive control of the engine 2 is conducted based on the first target engine speed N1, the drive control of the engine 2 continues based on the first target engine speed N1 until the pump capacity D of the hydraulic pump 6 becomes equivalent to or less than the second pump capacity D2.

Referring back to FIG. 9, the description on control Step S9 will be continued. In Step S9, the target engine speed N corresponding to the detected pump capacity D is obtained based on the preset relationship between the pump capacity D and the target engine speed N as shown in Table 2 of FIG. 10B, and then the process proceeds to Step S10. In Step S10, the value of the target engine speed N is corrected according to the change rate of the pump capacity of the hydraulic pump 6, the change rate of the pump discharge pressure, or the change rate of the engine output torque T. When these change rates (i.e. increase rates) are high, it is also possible to correct the target engine speed N to a higher one.

Step S10, which describes a control step for correcting the value of the target engine speed N, may be skipped.

Next, description will be made on Step S11 to Step S14 as control steps for obtaining the target engine speed corresponding to a detected engine output torque.

In Step S11, the detection signals from the pump capacity sensor 39 and the pump pressure sensor 38 are read out, and then the process proceeds to Step S12.

In Step S12, the engine output torque T is calculated based on the detection signals on the pump capacity and the pump pressure read out in Step S11. After the engine output torque T is calculated, the process proceeds to Step S13.

The following is a brief description on the process at Step S13 for obtaining the target engine speed N corresponding to the detected engine output torque T. As shown in FIG. 12, when the drive control of the engine is conducted based on the second target engine speed N2, the drive control of the engine continues based on the second target engine speed N2 until the detected engine output torque T reaches a predetermined first engine output torque T1.

When the detected engine output torque T becomes equivalent to or exceeds the first engine output torque T1, the target engine speed N corresponding to the detected engine output torque T is obtained based on the preset relationship between the engine output torque T and the target engine speed N shown in FIG. 12. The drive of the engine 2 is controlled so that the engine 2 is driven at the obtained target engine speed N.

Until the target engine speed N reaches the first target engine speed N1 or the second target engine speed N2, the target engine speed N corresponding to the detected engine output torque T is constantly obtained, whereby the drive control of the engine 2 is thus conducted based on the target engine speed N. In this control, the high-speed control area selecting calculator 32 functions as a second setting unit that sets the target engine speed corresponding to the engine output torque detected by the detector, the target engine speed having the second target engine speed as the lower limit.

For instance, when the currently-detected engine output torque T is defined as an engine output torque Tn, the target engine speed N is defined as the target engine speed Nn. By detecting that the engine output torque T is varied from the engine torque Tn to an engine torque Tn+1, the target engine speed Nn+1 corresponding to the engine output torque Tn+1 is newly obtained. The drive control of the engine 2 is thus conducted so that the engine 2 is driven at this newly-obtained target engine speed Nn+1.

When the detected engine output torque T reaches the predetermined second engine output torque T2, the drive control of the engine 2 is conducted based on the first target engine speed N1. When the drive control of the engine 2 is conducted based on the first target engine speed N1, the drive control of the engine 2 continues based on the first target engine speed N1 until the detected engine output torque T becomes equivalent to or less than the second engine output torque T2.

Figure 13:
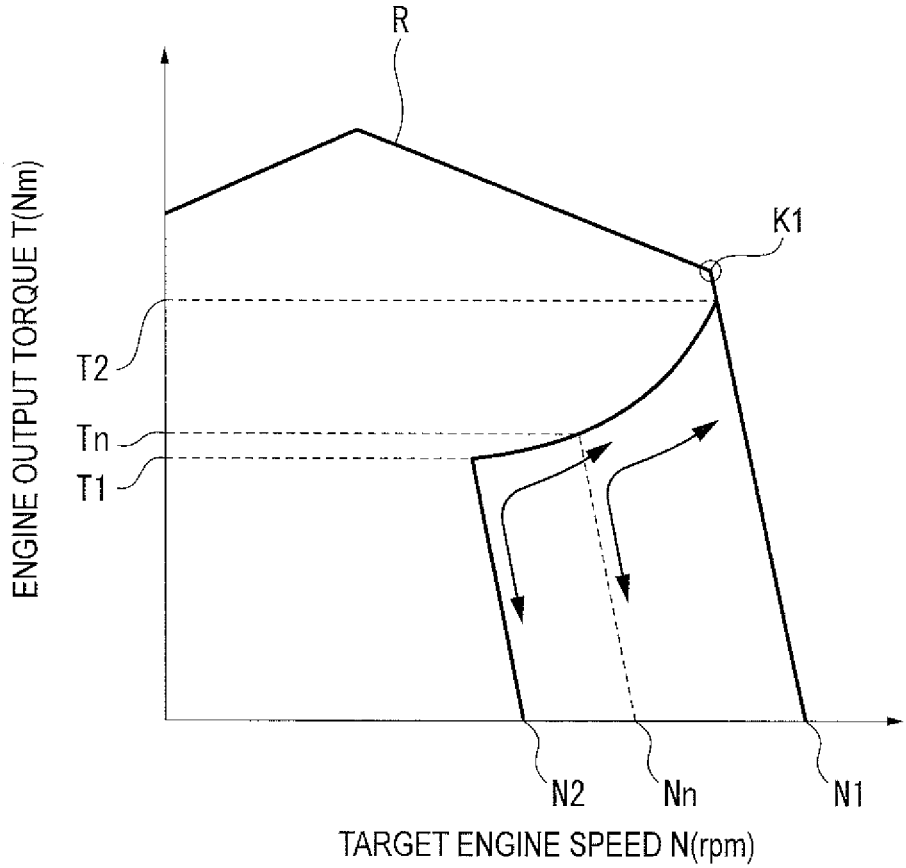
FIG. 13 illustrates a relationship between the target engine speed and the engine output torque.

Consequently, the drive control of the engine 2 is conducted by obtaining the target engine speed N corresponding to the detected engine output torque T, whereby the engine output torque line is allowed to pass through the maximum horsepower point K1 of the engine 2 as shown in FIG. 13.

Referring back to FIG. 9, the description on control Step S13 will be continued. In Step S13, the target engine speed N corresponding to the detected engine output torque T is obtained based on Table 3 (FIG. 10C) showing the preset relationship between the engine output torque T and the target engine speed N, and then the process proceeds to Step S14.

In Step S14, the value of the target engine speed N is corrected according to the change rate of the pump capacity of the hydraulic pump 6, the change rate of the pump discharge pressure, or the change rate of the engine output torque T. In other words, when these change rates (i.e. increase rates) are high, it is also possible to correct the target engine speed N to a higher one.

Step S14, described above as a control step for correcting the value of the target engine speed N, may be skipped.

When a higher one between the target engine speed N corresponding to the detected pump capacity D and the target engine speed N corresponding to the detected engine output torque T is used, both the control processes of Steps S8 to S10 and Steps S11 to S14 are performed. In this case, a control in Step S15 is performed after Step S10 and Step S14.

When the drive control of the engine 2 is conducted based on the target engine speed N corresponding to the detected pump capacity D or the target engine speed N corresponding to the detected engine torque T, the control of Step S15 is skipped and the process proceeds to Step S16. In other words, when only one of the control of Steps S8 to S10 and the control of Steps S12 to S14 is conducted, the control of Step S15 is skipped and the process proceeds to Step S16.

In Step S15, a higher one of the target engine speed N corresponding to the detected pump capacity D and the target engine speed N corresponding to the detected engine output torque T is selected. After the higher target engine speed N is selected, the process proceeds to Step S16.

In Step S16, the high-speed control area selecting calculator 32 outputs the high-speed control area command value 33 as shown in FIG. 4 so as to conduct the drive control of the engine using the target engine speed N. In this control, the high-speed control area selecting calculator 32 functions as a controller that controls a fuel injector 3 so as to provide the target engine speed obtained by the second setting unit. When the control of Step S16 is conducted, the process returns to Step S1 for repeating the control.

Next, a brief description will be made on a control during an operation with reference to FIG. 1. Specifically, description will be made on a control that is performed by detecting the pump capacity D when an operator deeply moves the operation lever 11*a* to accelerate the work equipment speed of a hydraulic excavator. Description on a control performed by detecting the engine output torque T is omitted because it is similar to the control performed by detecting the pump capacity D.

When the operation lever 11*a* shown in FIG. 1 is deeply moved so that the control valve 9 is switched to, for instance, the (I) position, an opening area 9*a* of the control valve 9 at the (I) position is increased and a differential pressure is reduced between the pump discharge pressure in the oil discharge path 25 and the load pressure in the pilot oil path 28. At this time, the pump control device 8, configured as a load sensing control device, operates for increasing the pump capacity D of the hydraulic pump 6.

Accordingly, the flow volume required in the hydraulic actuator to be operated is determined according to the opening area 9*a* of the control valve 9 in response to the operation lever 11*a*. Accordingly, the maximum flow volume required in the hydraulic actuator to be operated is determined according to the maximum opening area of the control valve 9 in response to the operation lever 11*a*. Moreover, the flow volume required in the plural hydraulic actuators to be operated can be determined according to the total of the opening areas 9*a* of the plural control valves 9 in response to one operation levers 11*a* or the plural operation levers 11*a*. The maximum flow volume required in the plural hydraulic actuators to be operated is determined according to the total of the opening areas of the plural control valves 9 to be operated.

The first pump capacity D1 can be set lower than the maximum pump capacity of the hydraulic pump 6. Description will be made below on an explanatory situation where a predetermined pump capacity is set as the first pump capacity D1. When the pump capacity of the hydraulic pump 6 is increased to the first pump capacity D1, the target engine speed N is controlled to change from the second target engine speed N2 to the target engine speed N corresponding to the detected pump capacity D as shown in FIG. 11.

The first target engine speed N1 and the high-speed control area F1 can be set by setting the fuel dial 4. For instance, a relationship between the first target engine speed N1 (i.e., the rated engine speed) and the second target engine speed N2 can be set according to a type of a hydraulic actuator to be operated or a combination of hydraulic actuators to be operated by the operation lever 11*a*.

When a type of a hydraulic actuator or a combination of hydraulic actuators to be operated by the operation lever 11*a* is determined and the first target engine speed N1 is selected by setting the fuel dial 4, a reduction range to the second target engine speed N2 can be set using the correspondence table in Table 1 of FIG. 10A.

Based on the thus determined relationship between the first target engine speed N1 and the second target engine speed N2, the first target engine speed N1 and the second target engine speed N2 in Table 2 of FIG. 10B and Table 3 of FIG. 10C can be corrected.

The drive control of the engine can be conducted along the high-speed control area F2 corresponding to the second target engine speed N2. When an operator further deeply moves the operation lever 11*a* after the pump capacity of the hydraulic pump 6 reaches the first pump capacity D1 in the high-speed control area F2, the drive control of the engine 2 is conducted so that the engine 2 is driven at the target engine speed N corresponding to the detected pump capacity D shown in FIG. 12. At this time, a control is sequentially conducted for shifting the high-speed control area to an optimal one within a range between the high-speed control area F2 and the high-speed control area F1.

The values of the first pump capacity D1 and the second pump capacity D2 can be set according to a type of a hydraulic actuator to be operated or a combination of hydraulic actuators to be operated. The value of the first pump capacity D1 can be made smaller in accordance with the larger reduction range for setting the second target engine speed N2 that is lower than the first target engine speed N1.

When the load of the hydraulic actuator 10 is increased after the shift to the high-speed control area F1, the engine output torque is increased. When the load of the hydraulic actuator 10 is increased in the high-speed control area F1, the engine output torque is increased up to the maximum horsepower point K1. After the load of the hydraulic actuator 10 is increased and the engine output torque T reaches the maximum torque line R between the high-speed control area F1 and the high-speed control area F2 or reaches the maximum horsepower point K1 in the high-speed control area F1, the engine speed and the engine output torque are thereafter matched on the maximum torque line R.

Since the high-speed control area is shiftable as described above, the working equipment is capable of consuming the maximum horsepower as ever when the shift to the high-speed control area F1 is done.

In other words, when the shift from the high-speed control area F2 to the high-speed control area F1 is done, the engine output torque is increased toward the maximum torque line R along a dotted line L1 shown in FIG. 3. A dotted line L2 represents a pattern of an increase directly toward the maximum torque line R at the high-speed control area Fn defined in the middle of the shift from the high-speed control area F2 to the high-speed control area F1. A dotted line L3 represents a conventional pattern where a control is performed while the high-speed control area F1 is fixed. Since the target engine speed N is variable according to the value of the detected pump capacity D or the detected engine output torque T, the high-speed control area Fn is also variable.

In the above-described example, the hydraulic circuit is exemplified by the one including the load sensing control device. However, the same applies to an open center type hydraulic circuit.

As described above, in the invention, the drive control of the engine can be started based on the second target engine speed N2 or the high-speed control area F2 at an improved fuel efficiency of the engine when the high-speed control area F1 is set according to the first target engine speed N1 in response to the command value by the fuel dial 4, and the second target engine speed N2 and the high-speed control area F2 of the low-speed side are set in advance corresponding respectively to the set first target engine speed N1 and the set high-speed control area F1.

Furthermore, a reduction range from the first target engine speed N1 to the second target engine speed N2 can be set using the correspondence tables prepared in advance according to a type of the operation lever 11*a* operated by the operator or a combination of hydraulic actuators operated by the operation lever 11*a*.

As described above, in the invention, the engine speed is controllable based on the second target engine speed N2 of the low-speed side in an area where a large pump capacity is not required or an area where a high engine output torque is not required. Furthermore, a reduction range for setting the second target engine speed N2 lower than the first target engine speed N1 can be selected according to a type of a hydraulic actuator operated by the operation lever 11*a* or a combination of hydraulic actuators simultaneously operated by the operation lever 11*a*. With this arrangement, the fuel efficiency of the engine can be largely improved.

On the other hand, in an area where a large pump capacity or a high engine output torque is required, the drive control of the engine is conducted so that the engine is driven at the target engine speed N determined in advance corresponding to the detected pump capacity D or the detected engine output torque T, whereby a sufficient operation speed required to operate a working equipment is obtained.

Further, in order to reduce the pump capacity D from a situation where the pump capacity D is large or to reduce the engine output torque T from a situation where the engine output is high, the drive control of the engine is conducted so that the engine is driven at the target engine speed N that is determined in advance corresponding to the detected pump capacity D or the detected engine output torque T, which results in an improvement in fuel efficiency.

The invention claimed is:

1. An engine control device comprising:

a variable displacement hydraulic pump driven by an engine;

a plurality of hydraulic actuators driven by a discharge pressure oil from the hydraulic pump;

a plurality of control valves that control the discharge pressure oil from the hydraulic pump so that the discharge pressure oil is supplied to the plurality of hydraulic actuators;

at least one operation lever that controls the plurality of control valves;

a detector that detects a pump capacity of the hydraulic pump;

a fuel injector that controls a fuel supplied to the engine;

a command unit that selects a set command value among variable command values and commands the set command value;

a first setting unit that sets a first target engine speed in response to the set command value commanded by the command unit and a second target engine speed based on the first target engine speed, the second target engine speed being lower than the first target engine speed;

a second setting unit that sets a third target engine speed according to the pump capacity, the third target engine speed having the second target engine speed as a lower limit; and a controller that controls the fuel injector so as to provide the third target engine speed set by the second setting unit, wherein a reduction range from the first target engine speed to the second target engine speed is set in the first setting unit according to a type of the hydraulic actuator operated by the at least one operation lever or a combination of the plurality of hydraulic actuators operated by the at least one operation lever.

2. The engine control device according to claim 1, wherein a value of the reduction range is set according to a maximum flow volume required by the type of the hydraulic actuator operated by the at least one operation lever, or according to the combination of the plurality of hydraulic actuators operated by the at least one operation lever.

3. The engine control device according to claim 1, wherein a value of the pump capacity at which the third target engine speed is increased beyond the second target engine speed is set to become smaller in the second setting unit as the reduction range becomes larger.

4. An engine control device comprising:

a variable displacement hydraulic pump driven by an engine;

a plurality of hydraulic actuators driven by a discharge pressure oil from the hydraulic pump;

a plurality of control valves that control the discharge pressure oil from the hydraulic pump so that the discharge pressure oil is supplied to the plurality of hydraulic actuators;

at least one operation lever that controls the plurality of control valves;

a first detector that detects a pump capacity of the hydraulic pump;

a fuel injector that controls a fuel supplied to the engine;

a command unit that selects a set command value among variable command values and commands the set command value;

a first setting unit that sets a first target engine speed in response to the set command value commanded by the command unit and a second target engine speed based on the first target engine speed, the second target engine speed being lower than the first target engine speed;

a second detector that detects an engine output torque;

a second setting unit that sets a third target engine speed to a higher one of a target engine speed according to the pump capacity and a target engine speed according to the engine output torque, the third target engine speed having the second target engine speed as the lower limit; and a controller that controls the fuel injector so as to provide the third target engine speed set by the second setting unit, wherein a reduction range from the first target engine speed to the second target engine speed is set in the first setting unit according to a type of the hydraulic actuator operated by the at least one operation lever or a combination of the plurality of hydraulic actuators operated by the at least one operation lever.

* * * * *